US007655189B2

(12) United States Patent
Willms et al.

(10) Patent No.: US 7,655,189 B2
(45) Date of Patent: Feb. 2, 2010

(54) DEVICE AND PROCESS FOR MANIPULATION OF A LIQUID

(75) Inventors: Thomas Willms, Castrop-Rauxel (DE); Gert Blankenstein, Dortmund (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 597 days.

(21) Appl. No.: 11/279,917

(22) Filed: Apr. 17, 2006

(65) Prior Publication Data

US 2006/0249387 A1 Nov. 9, 2006

(30) Foreign Application Priority Data

Apr. 15, 2005 (DE) ..... 10 2005 017 653

(51) Int. Cl.
*B01L 3/02* (2006.01)

(52) U.S. Cl. ..... 422/100

(58) Field of Classification Search ..... 422/100
See application file for complete search history.

(56) References Cited

U.S. PATENT DOCUMENTS

| | | | | |
|---|---|---|---|---|
| 4,902,629 | A | | 2/1990 | Meserol et al. |
| 5,399,316 | A | | 3/1995 | Yamada |
| 5,766,962 | A | | 6/1998 | Childs et al. |
| 5,853,670 | A | * | 12/1998 | Bunce ..... 422/100 |
| 6,953,058 | B2 | | 10/2005 | Fernandes et al. |
| 2004/0096358 | A1 | | 5/2004 | Blankenstein et al. |
| 2004/0183869 | A1 | | 9/2004 | Muller-Chorus et al. |
| 2004/0206408 | A1 | | 10/2004 | Peters et al. |

FOREIGN PATENT DOCUMENTS

| | | | |
|---|---|---|---|
| EP | 0 075 605 | A1 | 4/1983 |
| EP | 0 590 695 | A2 | 4/1994 |
| WO | WO 2004/007078 | A1 | 1/2004 |
| WO | WO 2004/050246 | A1 | 6/2004 |

* cited by examiner

*Primary Examiner*—Walter D Griffin
*Assistant Examiner*—Bobby Ramdhanie
(74) *Attorney, Agent, or Firm*—David S. Safran; Roberts Mlotkowski Safran & Cole, P.C.

(57) ABSTRACT

A device and a process for manipulation of a liquid, the ability of a liquid to flow from a first channel section in a second channel section being temporarily stopped by means of a capillary stop before it flows from the first channel section into the second channel section. Control which is accurate in time is easily enabled by the two channel sections being moved relative to one another for bridging or cancelling the capillary stop, especially being brought into contact.

20 Claims, 6 Drawing Sheets

DEVICE AND PROCESS FOR MANIPULATION OF A LIQUID

BACKGROUND OF THE INVENTION

1. Field of the Invention

This invention relates to a device and a process for manipulation of a liquid which can flow from a first channel section to a second channel section and which can be temporarily stopped by means of a capillary stop before overflowing from the first channel section into the second channel section.

2. Description of Related Art

This invention relates to microfluidic systems and devices. The following text relates to devices in which capillary forces act and are decisive especially for operation.

In order to move liquids from one location to a next in a time controlled manner, so-called capillary stops are known, as disclosed, for example, in European Patent Application EP 1 441 131 A1 and corresponding U.S. Patent Application Publication 2004/0206408. In this connection, the liquid is temporarily stopped in a channel or in a wide chamber due to the sudden increase of capillary force. For example, the capillary stop can be formed by an especially trough-like control channel which runs transversely. When the control channel is flooded, for example, by a control liquid or by the liquid itself, the liquid can overcome the capillary stop. Accuracy in time and/or location is critical in this connection. When there is no tapering of the channel cross section in the area of the capillary stop, starting of the liquid defined in time over the entire channel cross section can only be achieved with difficulty or not at all. When the channel in the area of the capillary stop is tapered to obtain better time control or definition, the previously wider liquid front is narrowed and then often widened again, and as a result of diffusion processes, the local resolution of the study can be significantly adversely affected. Another problem consists in flooding the control channel quickly in an exactly controlled manner with respect to time.

European Patent Application EP 1 419 818 A1 and corresponding U.S. Patent Application Publication 2004/0096358 discloses stepwise controlling the transport of a liquid, especially temporarily stopping it, using so-called selective venting. This is done by stopping the air displacement in the channel to be flooded. Opening of the vent allows the liquid to continue to flow. The problem here is the hardware cost. Furthermore, the same problems arise with respect to time and/or local definition as in the aforementioned capillary stop with a control channel.

Moreover, external triggers, such as electrical and/or magnetic fields, surge waves or pressure waves are known to temporarily stop a liquid or to start liquid transport. In this connection, the hardware complexity, and thus, the costs are high.

SUMMARY OF THE INVENTION

A primary object of this invention is to devise a device and a process for manipulation of a liquid which enable temporary stopping of the liquid in an especially wide channel, and which enable continued flow with an especially straight liquid front with a comparative low effort and accurate time control.

The aforementioned object is achieved by a device of the initially mentioned type being made such that the two channel sections can be moved relative to one another for bridging or canceling the capillary stop and/or can be brought into contact with one another on their ends, and by a process in which the two channel sections are moved relative to one another for bridging or canceling the capillary stop.

A basic idea of this invention is to bridge or cancel a capillary stop between a first channel section and a second channel section by the two channel sections moving relative to one another, especially being brought into contact with one another. This can take place, for example, by the two channel sections being pushed together.

The approach in accordance with the invention enables uniform starting of the liquid even for large channel cross sections. Therefore, overflow of the liquid from the first channel section into the second channel section is uniform over the entire liquid front. The liquid can start especially over the entire channel cross section at the same time. Accordingly, control which is accurate in time is possible. Furthermore, an at least essentially straight-line liquid front and especially a uniform laminar flow, preferably over the entire channel cross section, can be maintained even as flow continues from the first channel section into the second channel section. As a result, in addition to time definition, also good location definition is enabled. This is desirable for analyses, and especially when studying a liquid or for detection of analysis targets or reactants contained in it.

In accordance with this invention, the channel sections, and thus, the channel formed thereby, preferably have a relatively large cross section. In particular, they are made wide and chamber-like. To simplify the description, often only the channel or channel sections are discussed below.

Other advantages, features, properties and aspects of this invention will become apparent from the following description of preferred embodiments with reference to the accompanying drawings.

DETAILED DESCRIPTION OF THE PREFERRED EMBODIMENTS

In the figures, the same reference numbers are used for the same or similar parts, the corresponding or comparable properties and advantages being achieved, even if a repeated description is omitted. FIGS. 1 to 12 show devices 1 in accordance with the invention on an enlarged scale to illustrate various aspects and to facilitate the description.

Figure 1:
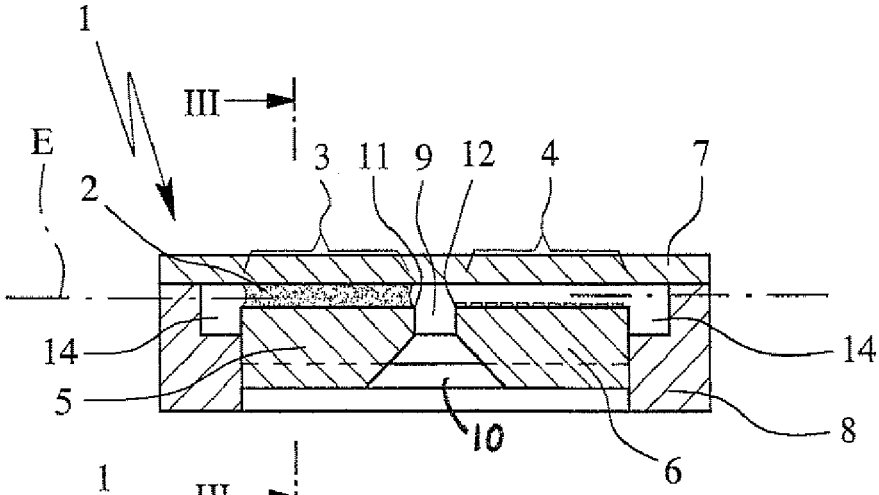
FIG. 1 is a schematic longitudinal sectional view of a device in accordance with a first embodiment of the invention.

FIG. 1 shows a first embodiment of the device 1 in accordance with the invention for manipulation of a liquid 2, especially a sample liquid, for example, for chemical and/or biological studies, especially for detection of an analysis target by a reagent, an antibody, or the like.

The device 1 has a first channel section 3 and a second channel section 4 for the liquid 2. The liquid 2 is taken up and/or conveyed especially exclusively by capillary forces from the channel sections 3, 4. However, other forces, such as pressure forces, centrifugal forces or the like, can also act.

In the illustrated embodiment, the device 1 has a first carrier section 5 and a second carrier section 6, and preferably, an associated cover 7. The cover 7 is preferably of a one-piece construction and is formed, for example, by a film or the like.

The first channel section 3 is formed between the first carrier section 5 and the cover 7. The second channel section 4 is formed between the second carrier section 6 and the cover 7. Therefore, the channel formed by the channel sections 3, 4 is preferably bordered or formed by only two opposing, especially essentially flat surfaces or flat sides, especially made without side walls. In particular, the channel sections 3, 4 are made such that the liquid 2 flows at least essentially laminarly over the preferably planar flat sides formed by the carrier sections 5, 6 and/or with an at least essentially linear liquid front transversely to the flow direction.

In the illustrated example, the device 1 has a carrier 8 for forming and/or holding the required microstructures, especially the carrier sections 5, 6. The carrier 8, and especially the carrier sections 5, 6, are preferably made essentially flat or plate-like and are optionally provided with the required recesses, channels or the like. The cover 7, in this embodiment, is made flat and preferably at least essentially without recesses. However, the reverse can also be true. If necessary both the carrier 8 and also the cover 7 can be relieved and/or made with projections for forming the desired structures and optionally for holding chemicals, reagents, test means or the like which are not shown. In particular, the device 1 is a so-called microchip (platform with microstructure).

Figure 2:
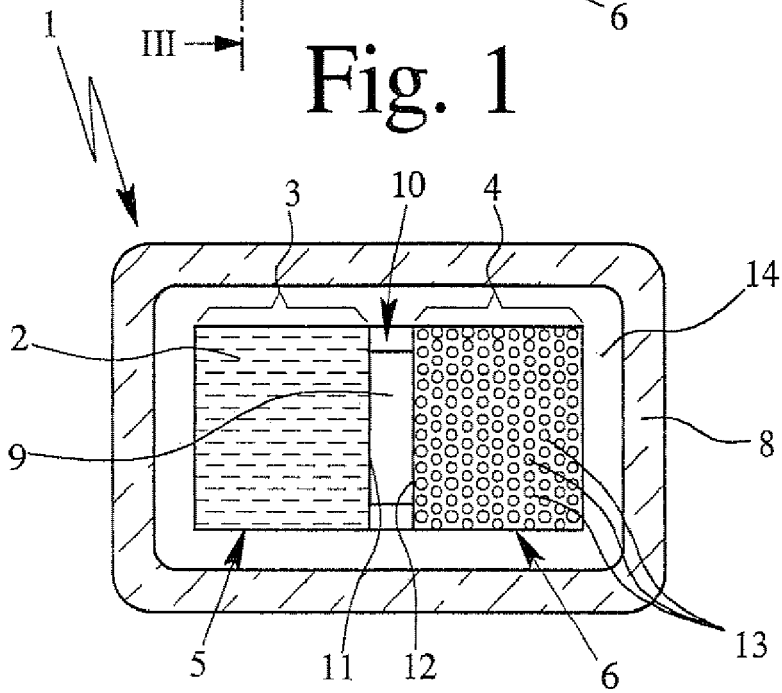
FIG. 2 is a schematic top view of the device shown in FIG. 1 with the cover removed.
Figure 3:
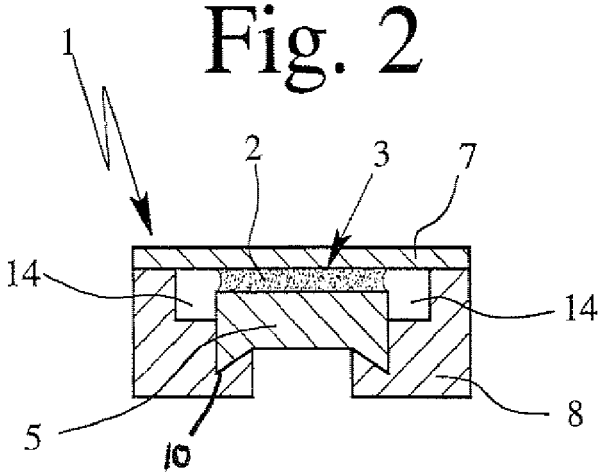
FIG. 3 is a sectional view of the device taken along line III-III in FIG. 1.

FIG. 2 shows the device 1 in an overhead view without the cover 7. FIG. 3 shows the device 1 in a section along line III-III from FIG. 1.

In the illustrated embodiment as shown in FIGS. 1 to 3, the cover 7 and the carrier 8 are not made integrally. Rather the cover 7 is preferably laid on, clamped on, cemented on, welded or in some other way connected to the carrier 8. This, for example, facilitates production. However, it is within the scope of the invention for the cover 7 and carrier 8 to be made integrally. In this case, then, at least one carrier section 5, 6 and especially both carrier sections 5, 6, are pushed laterally into the integral component. The device 1 is then accordingly made laterally open to accommodate the first and/or second carrier section 5, 6.

The channel sections 3, 4, hereinafter also called only the "channel", have preferably a flat and/or rectangular cross section transversely to the flow direction of the liquid 2 as shown in FIGS. 1 & 3. Therefore, the height of the channel, the distance of the preferably parallel surfaces which border the channel, in the illustrated embodiment is at most 2000 μm, preferably at most 500 μm, especially roughly 50 to 200 μm. The channel width is preferably about 100 to 5000 μm, especially about 200 to 4000 μm. The height of the channel is much less, especially by a factor of at least 10 or 100, than the channel width. The holding volume of the channel is preferably less than 1 ml, especially less than 100 μl, most preferably at most 10 μl.

Therefore, the device 1 forms a microfluidic system. In particular, the device 1 is used for microfluidic diagnostics for medical or nonmedical purposes and other studies.

The channel and the plane E of primary extension in the position of use run preferably at least essentially horizontally. Depending on the application or design, however, a different alignment is possible, especially the filling of the channel with the liquid 2 and/or the conveyance of the liquid 2 in the channel is determined or caused at least primarily by capillary forces.

The planes of primary extension of the channel sections 3, 4 in the illustrated embodiment lie at least essentially in the common plane E, as is indicated in FIG. 1. The upper or flat sides of the carrier sections 5, 6 run preferably parallel to the plane E.

The device 1 in accordance with the invention has a means for temporarily stopping the liquid 2. This means is formed by a capillary stop 9. The capillary stop 9 provides for at least temporary stopping of the liquid 2 before overflow from the first channel section 3 to the second channel section 4 and is located preferably on the end of the first channel section 3 or between the two channel sections 3, 4. The capillary stop 9 is achieved by a correspondingly sharp edge on the end of the first channel section 3 or carrier section 5 which lies downstream in the flow direction and/or another, especially sudden enlargement of the cross section, by which the capillary forces do not allow continued flow of the liquid 2 into the second channel section 4. In particular, the capillary stop 9 is formed by a trough-like recess or corresponding spacing of the two channel sections 3, 4 or carrier sections 5, 6.

Preferably, the capillary stop 9 extends transversely over the entire width of at least one flat side which borders the channel, preferably between the carrier sections 5, 6. Therefore, the capillary stop 9 extends preferably transversely to the flow direction of the liquid 2 and/or transversely to the lengthwise extension of the first or second channel section 3, 4.

FIGS. 1 to 3 show the device 1 in the state in which the capillary stop 9 is formed between the two channel sections 3, 4, especially by the two carrier sections 5, 6 being spaced apart. In this way, the liquid 2 which is located in the first channel section 3 or on the first carrier section 5 is temporarily stopped.

It is provided in accordance with the invention that the two channel sections 3, 4 can be moved relative to one another to bridge or cancel the capillary stop 9, especially can be brought into contact with one another. To do this, the channel section 3, 4 and especially the carrier sections 5, 6 can be moved translationally and/or rotationally relative to one another, and preferably can be pushed, deformed, folded and/or bent relative to one another.

In the illustrated embodiment, the two carrier sections 5, 6 are guided to be able to move relative to one another, especially by a guide means 10. The guide means 10 allows displacement of at least one carrier section 5 or 6. The corresponding carrier section 5, 6 or the two carrier sections 5, 6 is or are made, for example, in the manner of a carriage, and are movably guided in the corresponding guide sections of the guide means 10, which sections are preferably groove-like and/or are formed in the carrier 8.

The direction of movement of the two channel sections 3, 4 and carrier sections 5, 6 relative to one another runs preferably in or counter to the flow direction of the liquid 2 and/or in the lengthwise extension or in the plane E of primary extension of the channel sections 3, 4 or carrier sections 5, 6.

The two channel sections 3, 4 and carrier sections 5, 6 can be moved manually relative to one another, if necessary, especially can be brought into contact with one another. This enables a simple and economical structure. Preferably, the device 1 has a suitable manipulation means or the like (not shown) for facilitating such movement.

Alternatively or in addition, the device 1 preferably has an positioner or other drive (not shown), such as a motor, an electromagnet, a piezoelectric actuator or the like in order to move the channel sections 3, 4, and the carrier sections 5, 6, relative to one another, especially to bring them into contact with one another, to cancel or bridge the capillary stop 9. The drive can operate purely mechanically or electrically, electromagnetically, magnetically, pneumatically and/or hydraulically.

The two carrier sections 5, 6 can be pretensioned away from one another by means of a spring (not shown) or other pretensioning means such that the carrier sections 5, 6 cannot be unintentionally brought together. In the manual activation of the corresponding drive (not show), for example, the pretensioning force can be overcome and the channel sections 3, 4 and the carrier sections 5, 6 can be brought together as desired.

In the illustrated embodiment, the two carrier sections 5, 6 in the pushed-together state, meet one another with their transverse sides or at least their transverse edges 11, 12 which face the channel so that, in this pushed-together state, an at least essentially continuous surface is formed by the two top or flat sides of the carrier sections 5, 6. Thus, the capillary stop 9 is simultaneously cancelled or bridged preferably over the entire channel cross section, and the liquid 2 can flow out of the first channel section 3 formed by the first carrier section 5 into the second channel section 4 formed by the second carrier section 6.

As already explained, the flow or conveyance of the liquid 2 takes place exclusively by capillary force. In order to achieve the desired overflow of the liquid 2 from the first channel section 3 into the second channel section 4 with the capillary stop 9 bridged or cancelled, therefore, especially with the carrier sections 5, 6, pushed together, the capillary force acting on the liquid 2 in the second channel section 4 is preferably greater than in the first channel section 3. This higher capillarity can be achieved by the corresponding modification of the second carrier section 6, for example, by a corresponding coating, reduction of the distance to the cover 7 and/or as shown, by corresponding microstructures 13, especially elevations or the like on the second carrier section 6. For example, the microstructures 13 are arranged with a larger or increasing density on the second carrier section 6, in contrast to the first carrier section 5, in order to achieve the desired increase of the capillary force to the second channel section 4 or carrier section 6.

The second channel section 4, in the illustrated embodiment, constitutes a prolongation or continuation of the first channel section 3. In particular, the channel sections 3, 4 form a more or less continuous, especially linear channel with preferably an essentially constant cross section. Preferably, the cross section of the first channel section 3 directly in front of the capillary stop 9 corresponds at least essentially to the cross section of the second channel section 4 directly following the capillary stop 9.

In the illustrated example, the channel formed by the channel sections 3, 4 preferably has an essentially constant cross section. However, it is also within the scope of the invention to narrow the channel cross section in the area of the capillary stop 9. This cross section reduction is achieved preferably by uniform tapering of the liquid flow and subsequent spreading of the liquid flow.

The device 1 preferably has a means for preventing the liquid 2 from shooting laterally ahead in the flow direction and/or for producing a flow front which is as straight or as little curved as possible or for producing a uniform or laminar flow. Laterally, the channel sections 3, 4 are followed by the liquid stop which is formed especially by a groove-like or trough-like recess 14 in the carrier 8. The lateral liquid stop for the liquid 2 constitutes a flow barrier which cannot be overcome by capillary forces so that the liquid 2 is guided free of side walls along the open lengthwise sides of the channel sections 3, 4.

The recess 14 which forms the liquid stop is connected preferably sharp-edged to the channel sections 3, 4 and is formed especially in the carrier 8, as shown in FIGS. 1 & 3, extends therefore essentially only down with respect to the lateral projection of the channel. The recess can, however, alternately also extend to the top or to both sides of the lateral projection of the channel, therefore especially up and down.

The recess 14, which is preferably rectangular in cross section, leads to an especially stepped or sudden cross section enlargement, as is also the case for the capillary stop 9, such that the capillary forces are reduced, such that the indicated liquid stop for the liquid 2 is formed in the transition from the channel to the recess 14. In particular, the height of the recess 14 is at least twice as great as the height of the channel.

The recess 14 and the liquid stop formed by it extend in the illustrated example preferably along the open lengthwise side of the channel, especially around the channel sections 3, 4 and the carrier sections 5, 6 on all sides.

Figure 4A:
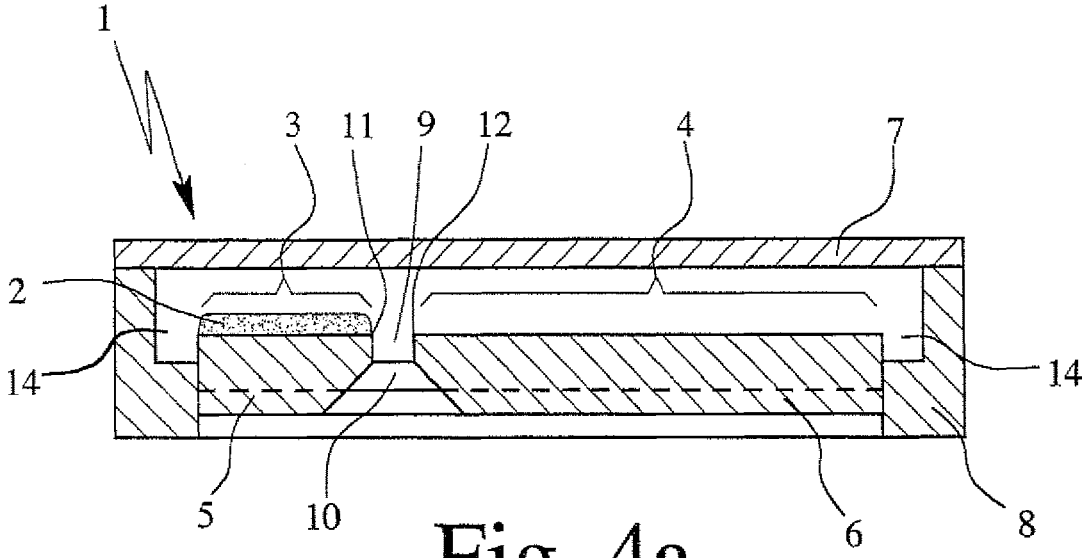
FIGS. 4*a* & 4*b* are schematic longitudinal sections of a device in accordance with a second embodiment of the invention with the channel sections separated and pushed together, respectively.
Figure 4B:
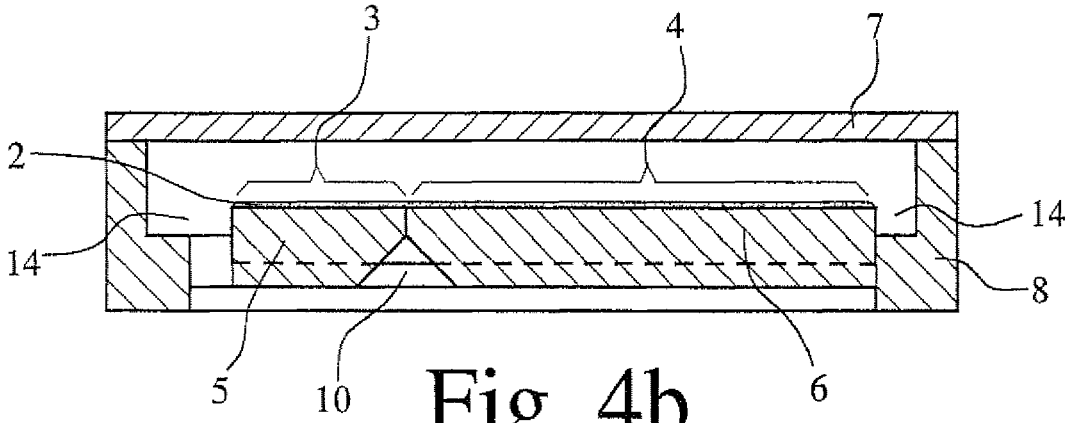

Corresponding guidance of the liquid 2 without side walls in the channel is also possible in the second embodiment of the device 1 shown in FIGS. 4*a* & 4*b* by the lateral recess 14 and the side liquid stop.

In the second embodiment the liquid 2 is routed preferably only on the bottom or flat side, therefore on the first carrier section 5 or the two carrier sections 5, 6. The liquid 2 is therefore not in contact with the opposing flat side which is formed by the cover 7. Instead, in the illustrated example the cover 7 is located accordingly higher or is optionally relieved in order to obtain the desired distance. FIG. 4*a* shows the device 1 with the channel section 3 and 4 (still) separated, FIG. 4*b* with the channel sections 3 and 4 pushed together.

In the second embodiment, the liquid 2, in the pushed-together state, therefore with the channel sections 3, 4 abutted, can be distributed at least essentially uniformly over the channel sections 3, 4, as indicated in FIG. 4*b*. This is especially the case when at least essentially the same capillary forces are acting over the entire length of the channel, and if not, simultaneous guidance between the cover 7 and the carrier sections 5, 6 takes place.

The thickness of the liquid film formed by the liquid 2 depends especially on the wetting behavior and on the supplied, then especially proportioned amount of liquid 2. Preferably, the corresponding dimensions as explained in the first embodiment for the channel apply to the liquid film.

The second embodiment shown in FIG. 4 is otherwise formed essentially according to the first embodiment so that the corresponding advantages, aspects and properties arise.

Figure 5:
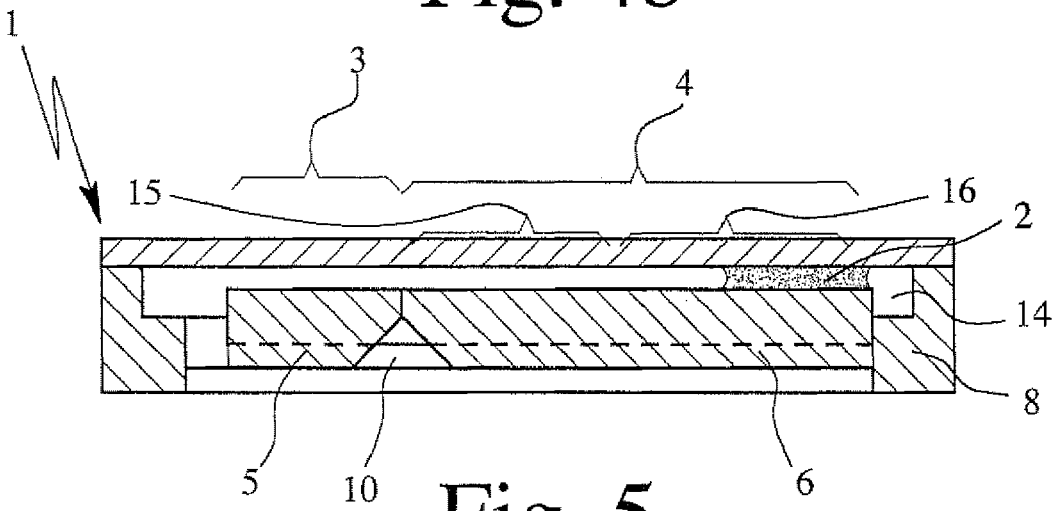
FIG. 5 is a schematic longitudinal sectional view of a device in accordance with a third embodiment of the invention with the channel sections pushed together.

FIG. 5 shows a third embodiment of the device 1 in accordance with the invention. Preferably, a reaction area 15 and a collecting area 16 are formed in the second channel section 4 and on the second carrier section 6. Together with the first channel section 3, for example, a three-chamber system can be formed which, if necessary, can have the function of a so-called immuno-assay. To do this, the first carrier section 5 can be provided or coated with a preferably soluble reagent which is dissolved in a first phase after supplying of the liquid 2 by the latter, or which reacts with the supplied liquid 2.

In a second phase, especially after a certain time has passed, the two channel sections 3, 4 or carrier sections 5, 6 are pushed together; this state is shown in FIG. 5, so that the liquid 2 can then flow into the reaction area 15 and finally into the collecting area 16 and can especially collect there. In the reaction area 15, the liquid 2 or the reagent contained in it and/or the analyzed substance contained in it, especially a complex formed from the reagent, preferably an antibody, and the analyzed substance, can react and bind especially to the immobilized antibodies or the like for detection. Then, detection can take place, for example, optically, in the reaction area 15.

In the above described sequence, especially for the qualitative or even quantitative detection of the analyzed substance of the liquid 2, it is preferably provided that the liquid 2 flows at least essentially completely from the first channel section 3, especially after a predetermined reaction time has passed, into the following reaction area 15 and then into the collecting area 16 in order to enable a defined reaction. In this case, a type of blockwise movement of the liquid 2 from the first channel section 3 to the end of the second channel section 4 arises. This type of motion can be achieved especially by the correspondingly rising capillary forces, preferably by the corresponding texturing or microstructuring and/or coating of the tops of the carrier sections 5, 6.

According to another alternative, the bridging or cancelling of the capillary stop 9 can be used only for actually starting a reaction or for studying a liquid 2. Thus, for example, for very time-critical reactions or studies the liquid 2, as the sample, can be first supplied to the channel section 3, especially via a fill opening or the like (not shown) or optionally even with introduction of the first carrier section 5 into the carrier 8, and thus, can be transported or stored there for a certain time. Only after the two carrier sections 5, 6 are moved together is the capillary stop 9 bridged or cancelled. The liquid 2 can then overflow into the second channel section 4 and start the time-critical reaction or study.

In the case of the above described reaction sequence, then, the individual phases can proceed in succession in the second channel section 4. In particular, for this purpose, the aforementioned, preferably soluble reagent is not in the first channel section 3 or on the first carrier section 5, but is preferably located at the start of the second channel section 4 or carrier section 6, especially in the dissolution area which is not shown separately in FIG. 5.

However. the described reaction sequence, or another sequence, can also be controlled in a more defined manner in time by several channel sections being brought into contact with one another, depending on the desired continuation of the reaction, with cancellation or bridging of the capillary stop 9 located in between. These fundamental possibilities will become apparent from the following description of other embodiments.

Figure 6A:
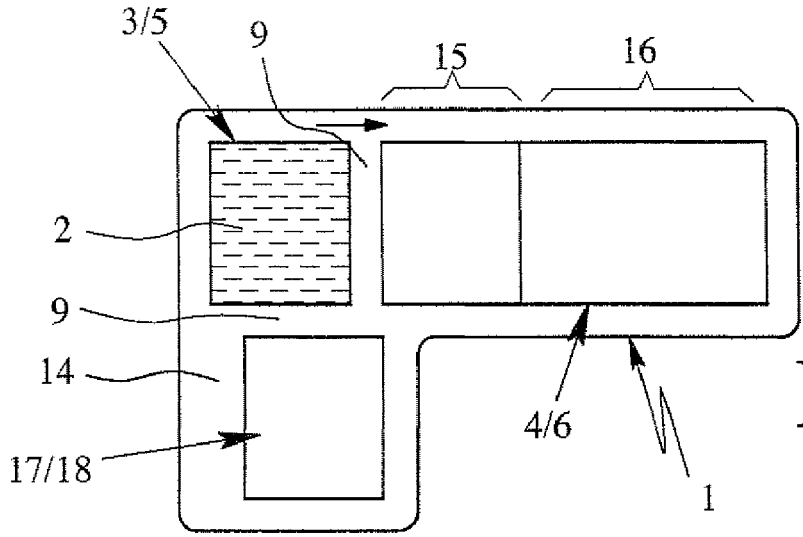
FIG. 6*a*-6*c* are schematic top views of a device in accordance with the invention according to a fourth embodiment.
Figure 6B:
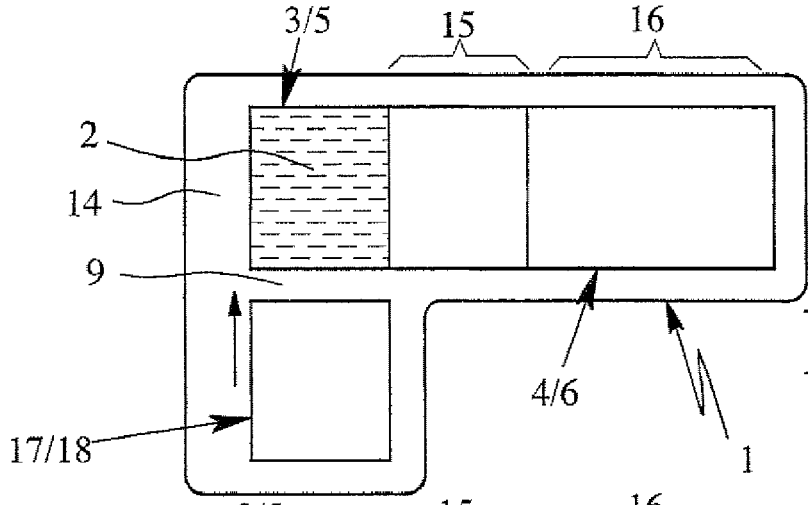
Figure 6C:
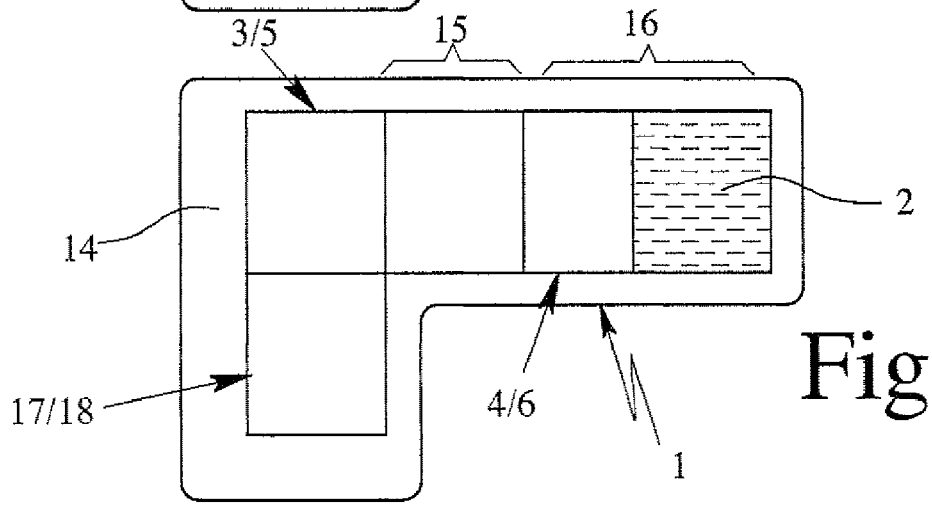

FIGS. 6*a* to 6*c* show in very schematic top views a device 1 in accordance with the invention without the cover 7 according to a fourth embodiment, with which especially the same reactions or reaction sequences as in the second embodiment described above can be implemented. In addition, the device 1 has at least one other channel section 17 which is formed accordingly by at least one further carrier section 18. The further channel section 17 or carrier section 18—hereinafter also called further section 17/18 for short—for example, makes it possible for another liquid, especially a washing liquid, to be supplied after overflow of the liquid 2 from the first channel section 3 or carrier section 5 into the second channel section 4 or carrier section 6, in which the further carrier section 18 with the other liquid is brought into contact with the first or second channel section 3, 4 or carrier section 5, 6. FIG. 6*a* shows the carrier sections 5, 6, 18 which have been moved away from one another. FIG. 6*b* shows the state in which the first carrier section 5 has already been moved to the second carrier section 6 and is in contact with it. FIG. 6*c* shows another phase in which the other carrier section 18, in the illustrated example, has been brought into contact with the first carrier section 5 in order to especially carry out a washing step by a washing liquid or the like being supplied. Thus, the reaction in the reaction region 15 can also be stopped again especially accurately.

Figure 7A:
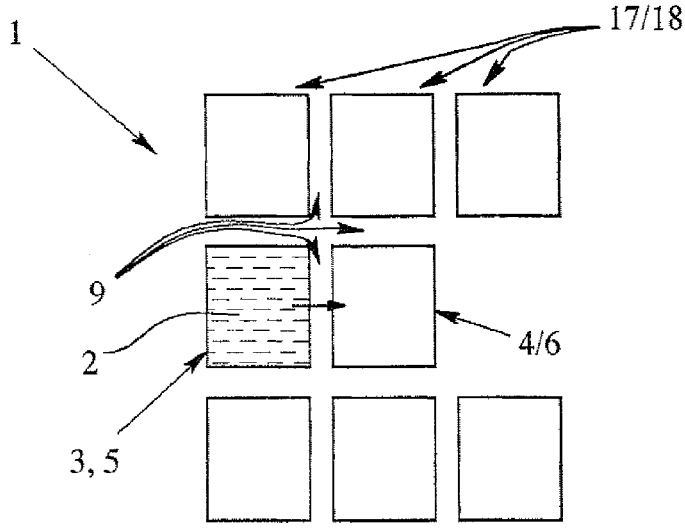
FIG. 7*a*-*c* are schematic top views of a device in accordance with a fifth embodiment of the invention.
Figure 7B:
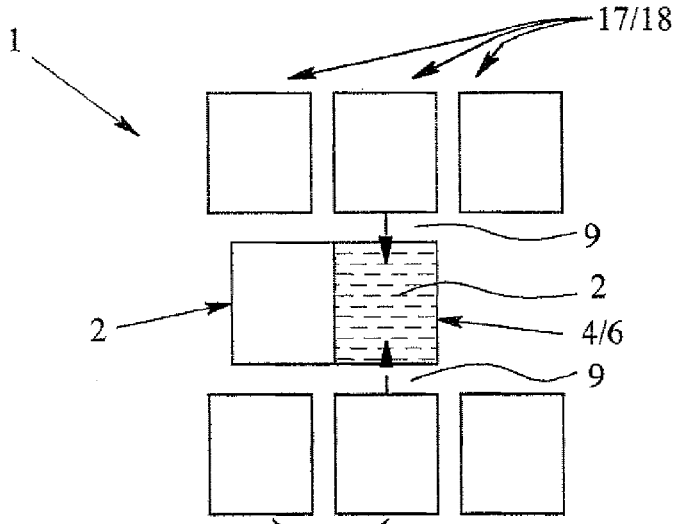
Figure 7C:
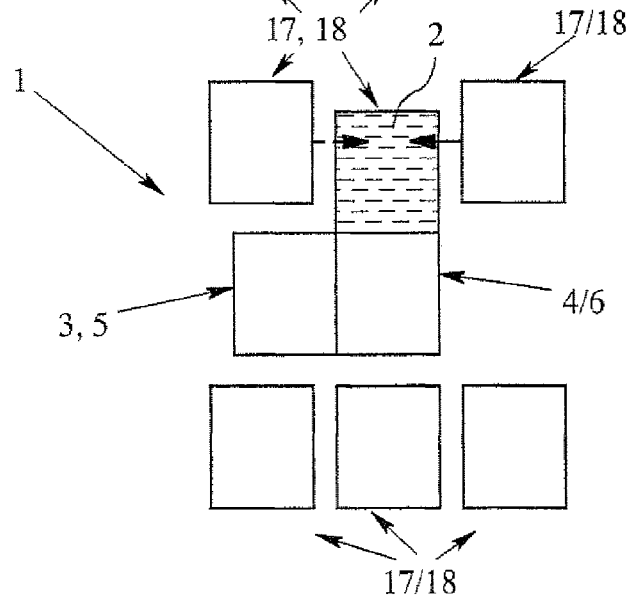

FIGS. 7*a* to 7*c* show, in a further abstracted top view, a fifth embodiment of the device 1 in accordance with the invention. In addition to the two first and second channel sections 3; 4 and carrier sections 5, 6, here, there are several further sections 17/18 which can be moved and especially brought into contact with one another in succession and/or at the same time and/or as desired toward one another in order to manipulate the liquid 2 or optionally also several liquids in the desired manner by bridging or cancelling the capillary stop 9 which exists between the individual sections 3, 4, 17 and 5, 6, 18 and to allow the desired reaction(s) to proceed or to enable tests.

FIG. 7*a* shows the still separated channel sections 3, 4, 17 and the carrier sections 5, 6, 18, the arrow indicating that the first channel section 3 or carrier section 5 is brought into contact with an adjacent, here the second channel section 4 or carrier section 6 by displacement. Then, the liquid 2 can flow from the first channel section 3 into the second channel section 4.

FIG. 7*b* shows the state in which the first channel section 3 and the second channel section 4 and the first carrier section 5 and the second carrier section 6 are in contact. The arrows indicate the displacement of to further sections 17, 18 in order to come into contact with the second channel section 4 and carrier section 6 preferably from opposite sides and especially at the same time. Accordingly, the liquid 2 can be relayed to or divided among the two further channel sections 17 and carrier sections 18.

However, the two her sections 17/18 can, if necessary, also perform different functions. For example, a further carrier element 18 can be used to supply another liquid, for example, washing liquid. The further carrier section 18 which is brought into contact preferably on the opposite side is then used, for example, to hold the liquid 2 from the second channel section 4 and carrier section 6 which is being displaced and especially washed out by the other liquid.

It is also possible for the two further carrier sections 18 shown in FIG. 7*b* to be brought into contact only alternatively, depending on the outcome of the previous reaction step or for selective variation of the reaction sequence, with the second channel section 4 or carrier section 6.

In FIG. 7*c*, the latter state is shown in which a further carrier section 18 is in contact with the second channel section 4 or carrier section 6 and the liquid 2 has already flowed into this further carrier section 18 or the further channel section 17 formed by it. In the illustrated example, the liquid 2 has completely overflowed. However, this depends especially on the acting capillary forces. For examples the liquid 2 can also be distributed among several sections 3, 4, 17 and 5, 6, 18. The two arrows indicate additional combination possibilities with other sections 17/18. Here, the aforementioned statements apply to the constellation as shown in FIG. 7*b* accordingly.

Figure 8:
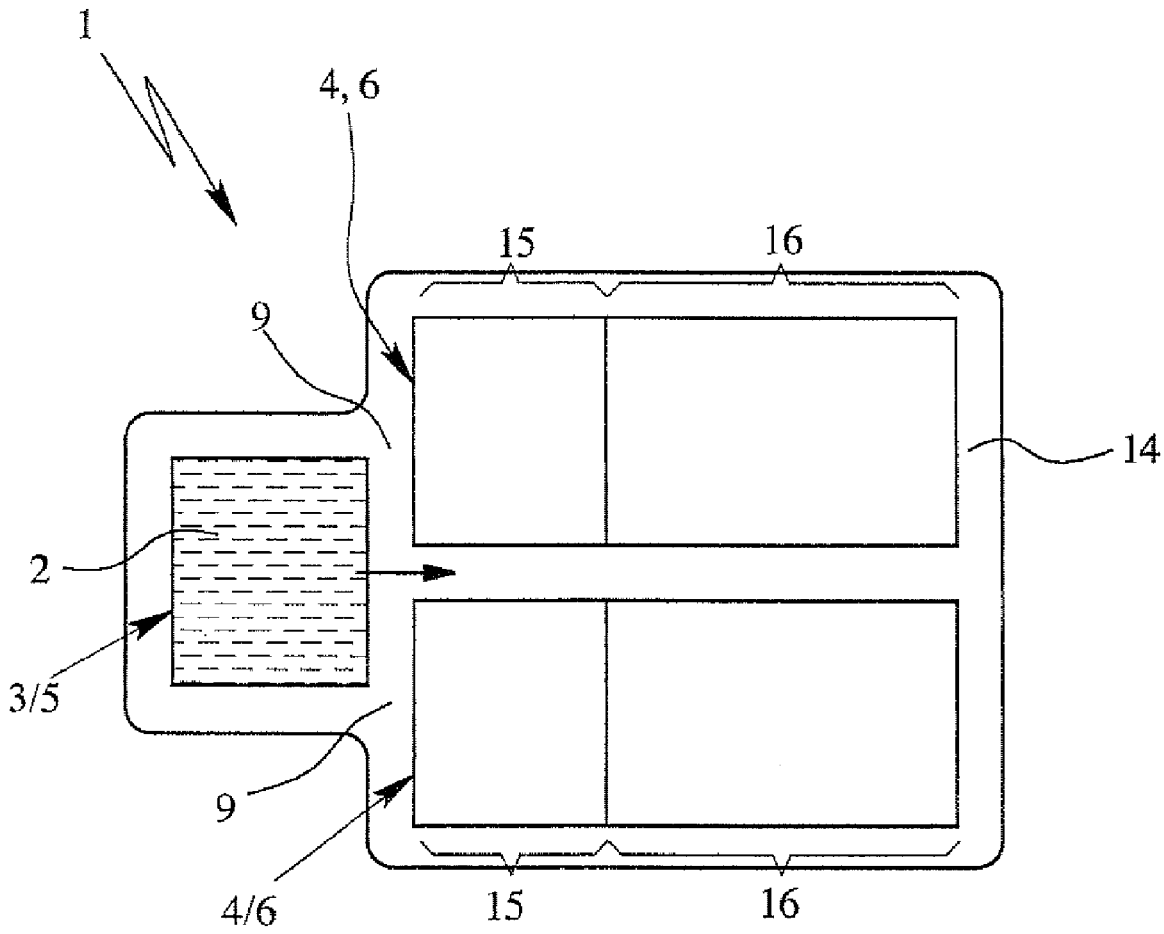
FIG. 8 is a schematic top view of a device in accordance with a sixth embodiment of the invention.

FIG. 8 shows a top view of a sixth embodiment of the device 1 in accordance with the invention without the cover 7. This embodiment corresponds preferably at least essentially to the third embodiment, and two second channel sections 4 or carrier sections 6 are arranged parallel to one another and can be exposed to liquid 2 in parallel. In particular, two reactions which proceed in parallel or independently of one another can be started at the same time. To do this, the first channel section 3 and carrier section 5 can be moved relative to one another with the liquid 2 and the two second channel sections 4 and carrier sections 6 can be moved relative to one another, especially can be brought into contact with one another. In the illustrated embodiment, this takes place in that the first carrier section 5 can be moved, especially pushed to the second carrier sections 6.

In the arrangement shown in FIG. 8, the first channel section 3 and carrier section 5 are offset and/or located in the middle with respect to the assigned second channel sections 4 or carrier sections 6 such that the first carrier section 5, as indicated by the arrow, can be brought into contact at the same time with the two other carrier sections 6 in order to enable simultaneous transfer of liquid 2 to the two second carrier sections 6.

If necessary, according to an unillustrated version, the first carrier section 5 can have an accordingly enlarged width and/or the second carrier sections 6 can have a reduced width so that when the first carrier section 5 comes into contact with the two further carrier sections 6, the capillary stops 9 located in between are each bridged or cancelled preferably at least essentially over the entire width of the two second carrier sections 6 in order to enable filling of the second channel sections 4 defined by the second carrier sections 6 with liquid 2 over the entire channel cross section, especially with a liquid front which runs at least essentially perpendicular to the flow direction S.

Figure 9:
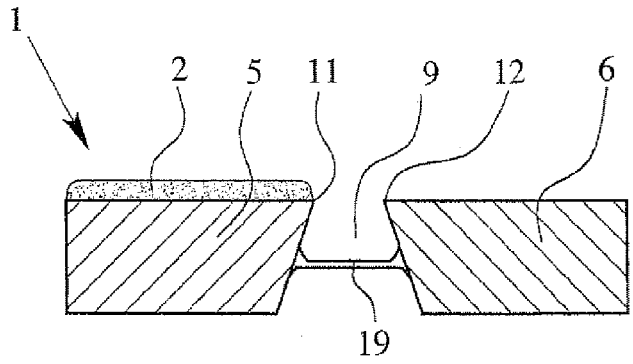
FIG. 9 is a schematic longitudinal sectional view of part of the device in accordance with a seventh embodiment of the invention with the channel sections separated.
Figure 10:
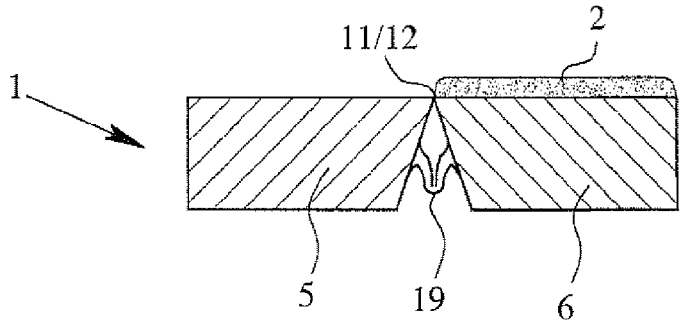
FIG. 10 is a view of the device shown to FIG. 9 with the channel sections pushed together.

FIGS. 9 and 10 show a seventh embodiment of the device in accordance with the invention in very schematic cross sections which illustrate only the first and second carrier sections 5, 6. FIG. 9 shows the spaced-apart state, therefore with not yet bridged or not cancelled capillary stop 9 between the first carrier section 5 and the second carrier section 6. Compared to the above explained embodiments, the two carrier sections 5, 6 in the seventh embodiment are connected to one another by a connecting section 19. The connecting section 19 can be deformed preferably flexibly and/or is made in the manner of a crosspiece. If necessary the carrier sections 5, 6 and the connecting section 19 are made in one piece.

During relative movement, especially pushing together, the connecting section 19 is deformed such that the two carrier sections 5, 6 touch at least in the area of their transverse sides or transverse edges 11, 12 for cancelling or bridging the capillary stop, as shown in FIG. 10. Then, the liquid 2 can overflow unhindered from the first carrier section 5 to the second carrier section 6 or can continue to flow in the channel which is not shown, as indicated in FIG. 10.

The preferably, elastic connecting section 19 leads to the advantage that the two carrier sections 5, 6 in production, and for example; in storage and/or transport with already added liquid cannot be unintentionally moved relative to one another so that unwanted cancellation or bridging of the capillary stop can be precluded.

Figure 11:
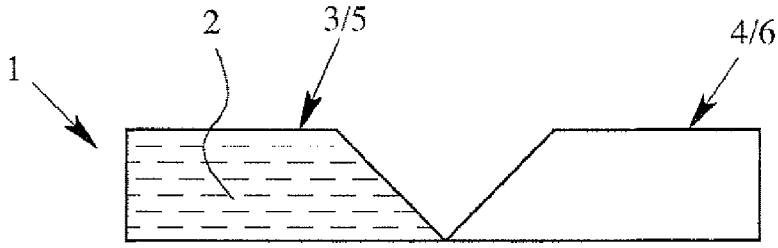
FIG. 11 is a schematic top view of part of a device in accordance with an eighth embodiment of the invention with the channel sections separated.
Figure 12:
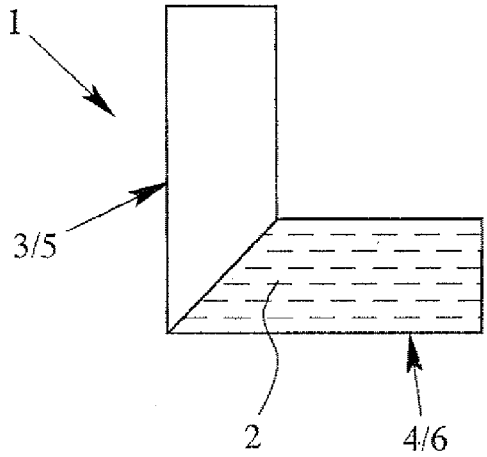
FIG. 12 is a representation of the device of FIG. 11 with the channel sections folded together.

FIGS. 11 & 12 show an eighth embodiment of the device 1 in accordance with the invention in schematic overhead views without a cover 7. Here, the two carrier sections 5, 6 can be turned or folded relative to one another in order to cancel or at least bridge the capillary stop 9 so that the liquid 2 can flow from the first carrier section 5 to the second carrier section 6. FIG. 11 shows the state in the unfolded state, therefore with the liquid 2 temporarily stopped. FIG. 12 shows the folded-together state in which the capillary stop 9 is cancelled, the liquid 2 having already flowed from the first carrier section 5 to the second carrier section 6.

Also other rotational movements and combinations of rotary and translational movements for cancelling or bridging of the capillary stop 9 are possible. For example, it is also possible to bend the device 1 or the carrier 8 around an axis which lies at least essentially in the plane E of primary extension and which runs transversely to the flow direction in order, in this way, to move adjacent channel sections or carrier sections to one another and to bridge or even cancel a capillary stop located in between so that then the liquid can continue to flow in the channel which has been formed.

Individual aspects and designs of the described embodiment can also be combined with one another in any manner.

INDUSTRIAL APPLICABILITY

This invention can be used in a versatile manner for microfluidic studies, diagnoses, and the like.

What is claimed is:

1. Device for manipulation of a liquid, comprising:
a first channel section and
a second channel section, and
a capillary stop formed between the channel sections for temporarily preventing liquid from flowing from the first channel section into the second channel section before the liquid flows from the first channel section into the second channel section,
wherein the two channel sections are located on carrier sections in the form of a flat platforms, and wherein the carrier sections are slidably movable into contact with one another for bridging or cancelling the capillary stop so that the liquid is able to flow from the first channel section into the second channel section.

2. Device in accordance with claim 1, wherein the channel sections are at least one of flat, rectangular and of the same in cross section.

3. Device in accordance with claim 1, wherein planes of primary extension of the channel sections lie at least in a common plane, such that the second channel section forms a prolongation or continuation of the first channel section in a position in which the capillary stop is bridged or cancelled.

4. Device in accordance with claim 1, wherein the channel sections are formed between said carrier sections and a common, continuous cover.

5. Device in accordance with claim 4, wherein the device has a guide means for translational or sliding guidance of at least one of the carrier sections.

6. Device in accordance with claim 4, transverse sides or edges of the carrier sections are in contact with each other in a position in which the capillary stop is bridged or cancelled.

7. Device in accordance with claim 1, wherein the movability of the channel sections is at least one of translational and rotational that is producible by at least one of pushing, deforming, folding and bending of the channel sections relative to one another.

8. Device in accordance with claim 4, wherein the carrier sections are connected to one another via an elastically deformable connecting section.

9. Device in accordance with claim 1, wherein the channel sections are angularly movable relative to one another into a position in which the capillary stop is bridged or cancelled.

10. Device in accordance with claim 1, wherein the channel sections are movable relative to one another in or counter to a direction of liquid flow between them.

11. Device in accordance with claim 1, wherein the channels sections are sized to produce a capillary force acting on the liquid in the second channel section that is greater than in the first channel section.

12. Device in accordance with claim 1, wherein the cross section of the first channel section upstream from the capillary stop corresponds at least essentially to the cross section of the second channel section downstream of the capillary stop.

13. Device in accordance with claim 1, wherein the capillary stop extends transversely to flow direction of the liquid between the channel sections across at least one entire side of the first channel section.

14. Device in accordance with claim 1, further comprising a carrier in which said carrier sections and channel sections are located, wherein the carrier sections and the channel sections are spaced from side walls of the carrier such that liquid is contained and travels therein without lateral side wall contact with the carrier.

15. Process for manipulation of a liquid, comprising the steps of:

supplying a liquid into a first channel section, temporarily preventing flow of the liquid from the first channel section into a second channel section by means of a capillary stop before the liquid flows from the first channel section into the second channel section, enabling flow of the liquid from the first channel section into the second channel section by producing movement of the channel sections relative to one another for bridging or cancelling the capillary stop wherein said channel sections are located on carrier sections in the form of a flat platforms, and wherein said movement of the channel sections is produced by slidable movement of the carrier sections into contact with one another.

16. Process in accordance with claim 15, wherein the bridging or cancelling of the capillary stop is produced by bringing the channel sections into end-to-end contact with each other.

17. Process in accordance with claim 16, wherein said end-to-end contact is produced by pushing of said carrier sections.

18. Process in accordance with claim 16, wherein said end-to-end contact is produced by movement of the channels sections relative to one another at least essentially in planes of their primary extension.

19. Process in accordance with claim 15, wherein at least a third channel section is provided with a capillary stop between it and at least one of the first and second channel sections, the channels sections being alternately moved toward one another for canceling or bridging the respective capillary stop.

20. Process in accordance with claim 15, wherein at least a third channel section is provided with a capillary stop between it and at least one of the first and second channel sections, the channels sections being moved toward one another at the same time for canceling or bridging the capillary stops between them.

* * * * *